US010927691B2

(12) United States Patent
Stafford et al.

(10) Patent No.: US 10,927,691 B2
(45) Date of Patent: Feb. 23, 2021

(54) NOZZLE SEGMENT AIR SEAL

(71) Applicant: Solar Turbines Incorporated, San Diego, CA (US)

(72) Inventors: Scott L. Stafford, San Diego, CA (US); Michael Theodore Austin, Murrieta, CA (US); Matthew Novaresi, San Diego, CA (US); James Maleski, San Diego, CA (US); John Francis Lorentzen, El Cajon, CA (US); Manuel Iribe-Moreno, San Diego, CA (US); Garrett Prins, Poway, CA (US); Keith Levon Harrell, El Cajon, CA (US)

(73) Assignee: Solar Turbines Incorporated, San Diego, CA (US)

( * ) Notice: Subject to any disclaimer, the term of this patent is extended or adjusted under 35 U.S.C. 154(b) by 43 days.

(21) Appl. No.: 16/360,744

(22) Filed: Mar. 21, 2019

(65) Prior Publication Data

US 2020/0300110 A1 Sep. 24, 2020

(51) Int. Cl.
*F01D 11/00* (2006.01)

(52) U.S. Cl.
CPC ..... *F01D 11/005* (2013.01)

(58) Field of Classification Search
None
See application file for complete search history.

(56) References Cited

U.S. PATENT DOCUMENTS

| | | | | |
|---|---|---|---|---|
| 3,975,114 | A * | 8/1976 | Kalkbrenner | F01D 11/005 415/210.1 |
| 5,797,723 | A | 8/1998 | Frost et al. | |
| 5,868,398 | A | 2/1999 | Maier et al. | |
| 5,997,247 | A | 12/1999 | Arraitz et al. | |
| 6,193,240 | B1 | 2/2001 | Johnson et al. | |
| 6,318,732 | B1 * | 11/2001 | Hoyes | F16J 15/0825 277/593 |
| 6,431,825 | B1 * | 8/2002 | McLean | F01D 11/005 277/644 |
| 6,733,234 | B2 | 5/2004 | Paprotna et al. | |
| 6,883,807 | B2 * | 4/2005 | Smed | F01D 11/005 277/641 |
| 7,128,323 | B2 * | 10/2006 | Iguchi | F16J 15/0887 277/644 |
| 7,316,402 | B2 * | 1/2008 | Paauwe | F01D 11/005 277/641 |

(Continued)

FOREIGN PATENT DOCUMENTS

| | | |
|---|---|---|
| EP | 2551562 | 1/2013 |
| JP | 2017089689 | 5/2017 |
| WO | 200070192 | 11/2000 |

*Primary Examiner* — Woody A Lee, Jr.
(74) *Attorney, Agent, or Firm* — Procopio, Cory, Hargreaves & Savitch LLP

(57) ABSTRACT

This disclosure provides a seal strip assembly for a sealing strip slot to reduce air leakage between gas turbine nozzle segments. The seal strip assembly includes a bimetal element and a backing plate. The bimetal element includes a first layer with a first thermal coefficient of thermal expansion and a second layer with a second coefficient of thermal expansion. The second coefficient of thermal expansion is lower than the first coefficient of thermal expansion allowing the bimetal element to expand with an increase in surrounding temperature.

17 Claims, 7 Drawing Sheets

(56) References Cited

U.S. PATENT DOCUMENTS

| | | | | |
|---|---|---|---|---|
| 7,334,800 | B2 | 2/2008 | Minnich | |
| 7,360,769 | B2 * | 4/2008 | Bennett | F01D 11/005 277/641 |
| 7,451,989 | B1 | 11/2008 | Cornett et al. | |
| 8,069,673 | B2 | 12/2011 | Kunitake et al. | |
| 8,210,799 | B1 * | 7/2012 | Rawlings | F01D 11/005 415/135 |
| 8,398,090 | B2 | 3/2013 | McMahan et al. | |
| 8,434,999 | B2 | 5/2013 | Amaral et al. | |
| 8,556,578 | B1 * | 10/2013 | Memmen | F01D 5/189 415/135 |
| 8,651,497 | B2 * | 2/2014 | Tholen | F16J 15/0887 277/644 |
| 9,115,808 | B2 | 8/2015 | Simmons et al. | |
| 9,771,895 | B2 | 9/2017 | Kramer | |
| 9,850,772 | B2 | 12/2017 | Sarawate et al. | |
| 9,963,990 | B2 | 5/2018 | Vetters et al. | |
| 10,138,742 | B2 * | 11/2018 | Budnick | F02C 7/28 |
| 10,240,473 | B2 * | 3/2019 | Davis | F01D 11/003 |
| 2003/0039542 | A1 | 2/2003 | Cromer | |
| 2008/0053107 | A1 * | 3/2008 | Weaver | F01D 9/023 60/800 |
| 2010/0247005 | A1 * | 9/2010 | Aschenbruck | F01D 9/023 384/15 |
| 2013/0028713 | A1 * | 1/2013 | Giri | F16J 15/064 415/135 |
| 2014/0248120 | A1 * | 9/2014 | Graves | G05D 23/1854 415/1 |
| 2017/0370239 | A1 | 12/2017 | Venkataramani et al. | |

* cited by examiner

NOZZLE SEGMENT AIR SEAL

TECHNICAL FIELD

This disclosure relates to gas turbine engines. More specifically, this disclosure relates to air seals for nozzle segments.

BACKGROUND

Gas turbine engines use strip seals between adjacent static components such as ring segments, casing components and stator vanes. Strip seals are long, ruler like seals that fit into aligned slots in each adjacent component. Leakage of air between nozzle segments and around strip seals can decrease turbine efficiency and engine power.

U.S. Pat. No. 8,434,999 to Amaral describes a spline seal for a hot gas path component. The spline seal may include a first metal layer and a second metal layer. The first metal layer may have a first volumetric thermal expansion coefficient. The second metal layer may be disposed adjacent the first metal layer and have a second volumetric thermal expansion coefficient. The second volumetric thermal expansion coefficient may be higher than the first volumetric thermal expansion coefficient. When the spline seal is exposed to a heat source, the first and second metal layers may deform to provide a seal between the hot gas path component and an adjacent hot gas path component.

The present disclosure is directed toward overcoming one or more of the problems discovered by the inventors.

SUMMARY

In general, this disclosure describes a seal strip assembly for seal strip slots formed by adjacent seal strip grooves in adjacent turbine nozzle segments within a gas turbine engine, The systems, methods and assemblies of this disclosure each have several innovative aspects, no single one of which is solely responsible for the desirable attributes disclosed herein.

The sealing strip assembly comprising a backing plate and a bimetal element. The bimetal element is disposed proximate to the backing plate and includes a first layer, a second layer and an edge. The first layer has a first coefficient of thermal expansion. The second layer is disposed adjacent to the first layer has a second coefficient of thermal expansion. The second coefficient of thermal expansion is lower than the first coefficient of thermal expansion.

Other features and advantages of the present disclosure should be apparent from the following description which illustrates, by way of example, aspects of the disclosure.

BRIEF DESCRIPTION OF THE FIGURES

The details of embodiments of the present disclosure, both as to their structure and operation, may be gleaned in part by study of the accompanying drawings, in which like reference numerals refer to like parts, and in which.

DETAILED DESCRIPTION

The detailed description set forth below, in connection with the accompanying drawings, is intended as a description of various embodiments and is not intended to represent the only embodiments in which the disclosure may be practiced. The detailed description includes specific details for the purpose of providing a thorough understanding of the embodiments. However, it will be apparent to those skilled in the art that embodiments of the invention can be practiced without these specific details. In some instances, well-known structures and components are shown in simplified form for brevity of description. In some instances, reference numbers are left out of the figures for ease of viewability.

Figure 1:
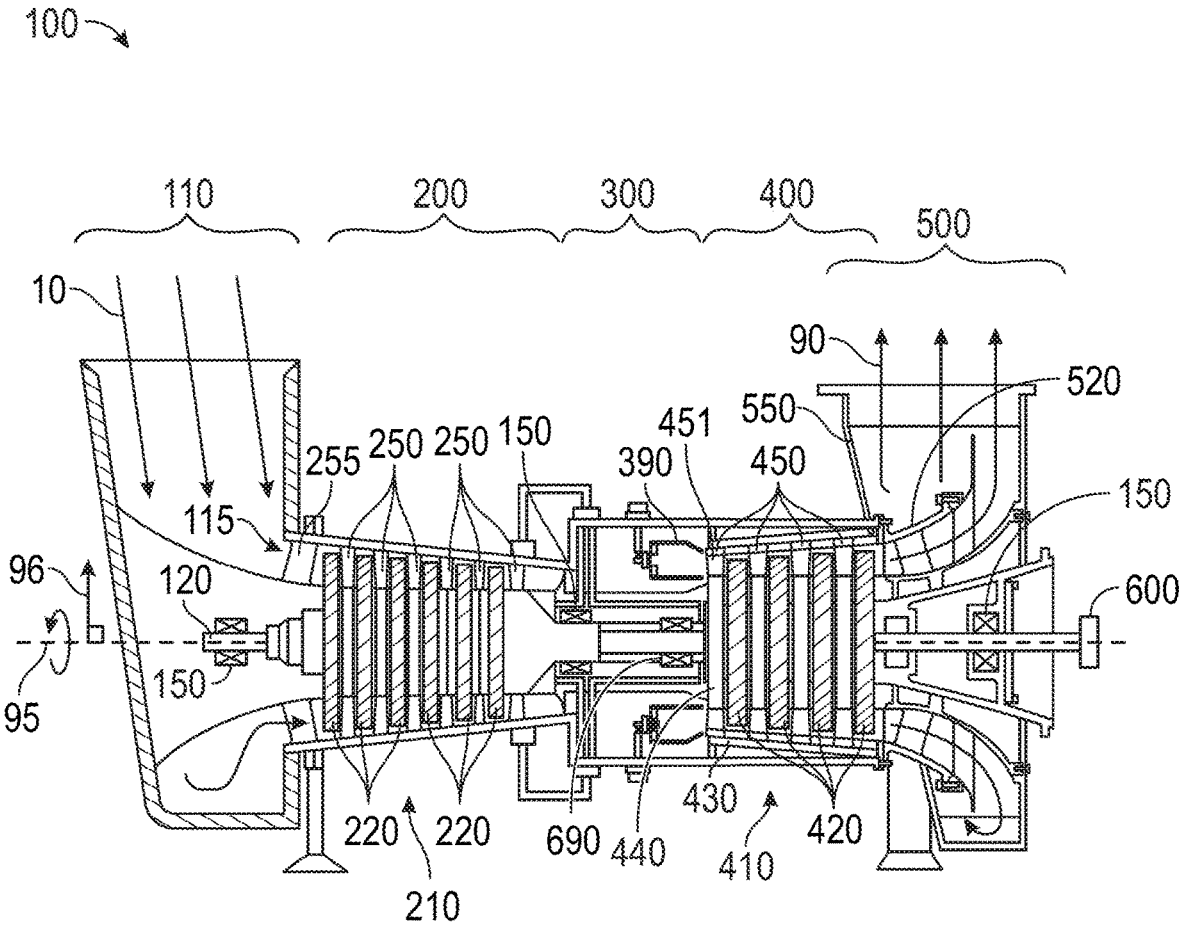
FIG. 1 is a schematic illustration of an exemplary gas turbine engine.

FIG. 1 is a schematic illustration of an exemplary gas turbine engine. Some of the surfaces have been left out or exaggerated (here and in other figures) for clarity and ease of explanation. Also, the disclosure may reference a forward and an aft direction. Generally, all references to "forward" and "aft" are associated with the flow direction of primary air 10 (i.e., air used in the combustion process), unless specified otherwise. For example, forward is "upstream" relative to primary air flow, and aft is "downstream" relative to primary air flow.

In addition, the disclosure may generally reference a center axis 95 of rotation of the gas turbine engine, which may be generally defined by the longitudinal axis of its shaft 120 (supported by a plurality of bearing assemblies 150). The center axis 95 may be common to or shared with various other engine concentric components. All references to radial, axial, and circumferential directions and measures refer to center axis 95, unless specified otherwise, and terms such as "inner" and "outer" generally indicate a lesser or greater radial distance from center axis 95, wherein a radial 96 may be in any direction perpendicular and radiating outward from center axis 95.

A gas turbine engine 100 includes an inlet 110, a shaft 120, a compressor 200, a combustor 300, a turbine 400, an exhaust 500, and a power output coupling 600. The gas turbine engine 100 may have a single shaft or a dual shaft configuration.

The compressor 200 includes a compressor rotor assembly 210, compressor stationary vanes (stators) 250, and inlet guide vanes 255. The compressor rotor assembly 210 mechanically couples to shaft 120. As illustrated, the compressor rotor assembly 210 is an axial flow rotor assembly. The compressor rotor assembly 210 includes one or more compressor disk assemblies 220. Each compressor disk assembly 220 includes a compressor rotor disk that is circumferentially populated with compressor rotor blades. Stators 250 axially follow each of the compressor disk assemblies 220. Each compressor disk assembly 220 paired with the adjacent stators 250 that follow the compressor disk assembly 220 is considered a compressor stage. Compressor 200 includes multiple compressor stages. Inlet guide vanes 255 axially precede the compressor stages at the beginning of an annular flow path 115 through the gas turbine engine 100.

The turbine 400 includes a turbine rotor assembly 410 and turbine nozzles 450 within a turbine housing 430. The turbine rotor assembly 410 mechanically couples to the shaft 120. In the embodiment illustrated, the turbine rotor assembly 410 is an axial flow rotor assembly. The turbine rotor assembly 410 includes one or more turbine disk assemblies 420. Each turbine disk assembly 420 includes a turbine disk that is circumferentially populated with turbine blades. Turbine nozzles 450 axially precede each of the turbine disk assemblies 420. Each turbine disk assembly 420 paired with the adjacent turbine nozzles 450 that precede the turbine disk assembly 420 is considered a turbine stage. Turbine 400 includes multiple turbine stages.

The exhaust 500 includes an exhaust diffuser 520 and an exhaust collector 550 that can collect exhaust gas 90. The power output coupling 600 may be located at an end of shaft 120.

Figure 2:
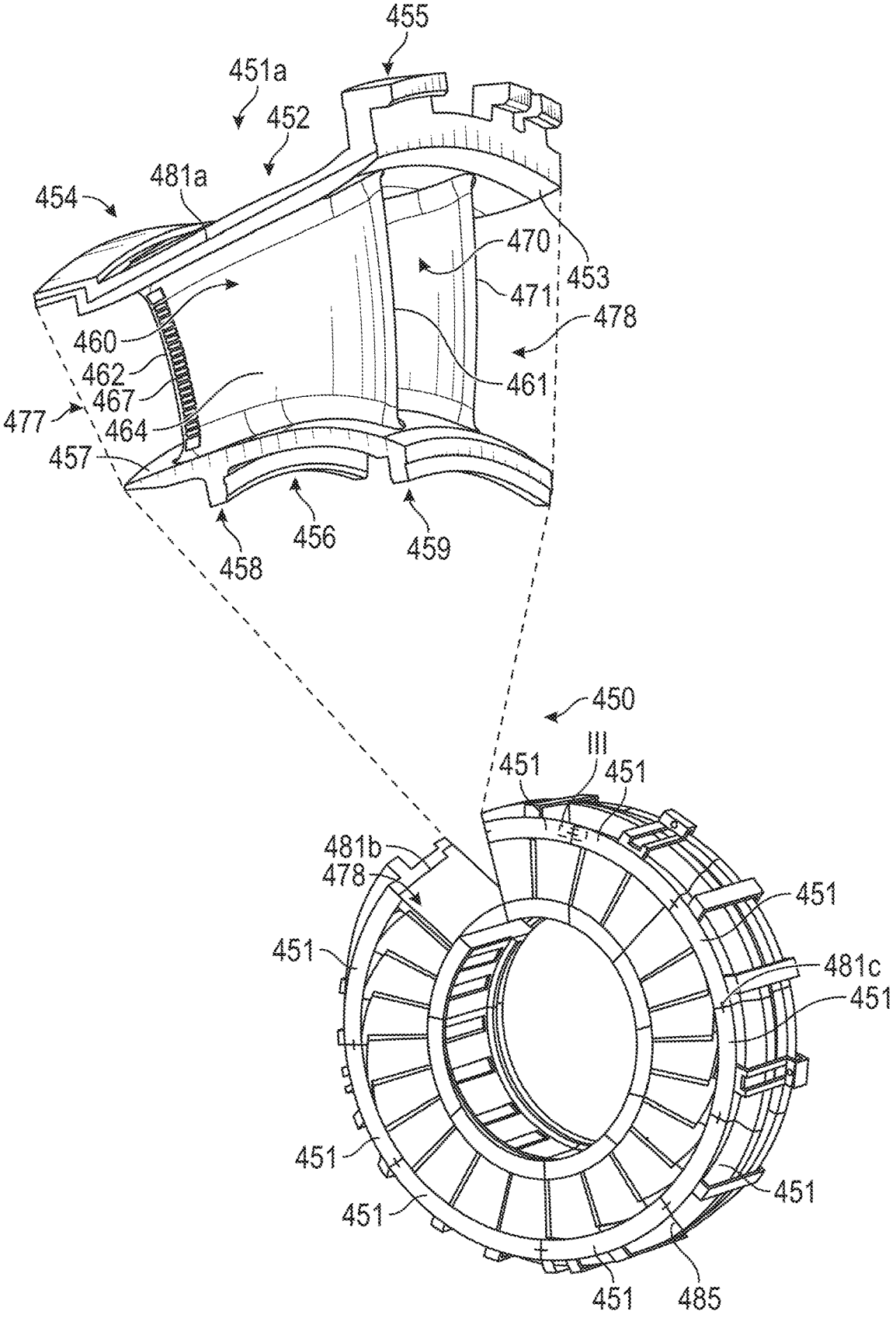
FIG. 2 is a perspective view of a turbine nozzle of the gas turbine engine of FIG. 1 with one turbine nozzle segment shown separated from the turbine nozzle and enlarged.

FIG. 2 is a perspective view of a turbine nozzle of the gas turbine engine of FIG. 1 with one turbine nozzle segment shown separated from the turbine nozzle and enlarged. Some features are not shown and/or not labelled for ease of viewability. The gas turbine engine 100 can have more than one nozzle 450 as shown in FIG. 1. The turbine nozzle(s) 450 can alternate with the turbine disk assemblies 420.

Each nozzle 450 can have a plurality of turbine nozzle segments (nozzle segments) 451 that can be assembled radially about the center axis 95 to form the complete assembly of the turbine nozzle 450. A first turbine nozzle segment 451*a* is shown separated from the turbine nozzle and enlarged 450 in FIG. 2.

The first turbine nozzle segment 451*a* includes outer shroud 452, inner shroud 456, a first airfoil 460, and a second airfoil 470. In other embodiments, first turbine nozzle segment 451*a* can include more or fewer airfoils, such as one airfoil, three airfoils, or four airfoils. Outer shroud 452 may be located adjacent and radially inward from turbine housing 430 when first turbine nozzle segment 451*a* is installed in gas turbine engine 100. Outer shroud 452 includes outer endwall 453. Outer endwall 453 may be a portion of an annular shape, such as a sector. For example, the sector may be a sector of a toroid (toroidal sector) or a sector of a hollow cylinder. The toroidal shape may be defined by a cross-section with an inner edge including a convex shape. Multiple outer endwalls 453 are arranged to form the annular shape, such as a toroid, and to define the radially outer surface of the annular flow path 115 through a turbine nozzle 450. Outer endwall 453 may be coaxial to center axis 95 when installed in the gas turbine engine 100.

Outer shroud 452 may also include outer forward rail 455 and outer aft rail 454. Outer forward rail 455 extends radially outward from outer endwall 453. In the embodiment illustrated in FIG. 2, outer forward rail 455 extends from outer endwall 453 at an axial end of outer endwall 453. In other embodiments, outer forward rail 455 extends from outer endwall 453 near an axial end of outer endwall 453 and may be adjacent to the axial end of outer endwall 453. Outer forward rail 455 may include a lip, protrusion or other features that may be used to secure first turbine nozzle segment 451*a* to turbine housing 430.

Outer aft rail 454 may also extend radially outward from outer endwall 453. In the embodiment illustrated in FIG. 2, outer aft rail 454 is 'L' shaped, with a first portion extending radially outward from the axial end of outer endwall 453 opposite the location of outer forward rail 455, and a second portion extending in the direction opposite the location of outer forward rail 455 extending axially beyond outer endwall 453. In other embodiments, outer aft rail 454 includes other shapes and may be located near the axial end of outer endwall 453 opposite the location of outer forward rail 455 and may be adjacent to the axial end of outer endwall 453 opposite the location of outer forward rail 455. Outer aft rail 454 may also include other features that may be used to secure the first turbine nozzle segment 451*a* to turbine housing 430.

Inner shroud 456 is located radially inward from outer shroud 452. Inner shroud 456 may also be located adjacent and radially outward from turbine diaphragm 440 (FIG. 1) when the first turbine nozzle segment 451*a* is installed in gas turbine engine 100. Inner shroud 456 includes inner endwall 457. Inner endwall 457 is located radially inward from outer endwall 453. Inner endwall 457 may be a portion of an annular shape, such as a sector. For example, the sector may be a portion of a nozzle ring. Multiple inner endwalls 457 are arranged to form the annular shape, such as a toroid, and to define the radially inner surface of the flow path through a turbine nozzle 450. Inner endwall 457 may be coaxial to outer endwall 453 and center axis 95 when installed in the gas turbine engine 100.

Inner shroud 456 may also include inner aft rail 458 and inner forward rail 459. Inner aft rail 458 extends radially inward from inner endwall 457. In the embodiment illustrated in FIG. 2, inner aft rail 458 extends from inner endwall 457 at an axial end of inner endwall 457. In other embodiments, inner aft rail 458 extends from inner endwall 457 near an axial end of inner endwall 457 and may be adjacent inner endwall 457 near the axial end of inner endwall 457. Inner aft rail 458 may include a lip, protrusion or other features that may be used to secure first turbine nozzle segment 451*a* to turbine diaphragm 440.

The inner forward rail 459 may also extend radially inward from inner endwall 457. In the embodiment illustrated in FIG. 2, inner forward rail 459 extends from inner endwall 457 near the axial end of inner endwall 457 opposite the location of inner aft rail 458 and may be adjacent the axial end of inner endwall 457 opposite the location of inner aft rail 458. Inner forward rail 459 may also include a lip, protrusion or other features that may be used to secure first turbine nozzle segment 451*a* to turbine diaphragm 440.

The airfoil 460 extends between the outer endwall 453 and the inner endwall 457. The airfoil 460 includes the leading edge 461, the trailing edge 462, the pressure side wall 463 (shown in FIG. 3), and the suction side wall 464. The leading edge 461 extends from the outer endwall 453 to the inner endwall 457 at the most upstream axial location where highest curvature is present. The leading edge 461 may be located near the outer forward rail 455 and the inner aft rail 458. The trailing edge 462 may extend from the outer endwall 453 axially offset from and distal to the leading edge 461, adjacent the axial end of the outer endwall 453 opposite the location of the leading edge 461 and from the inner endwall 457 adjacent the axial end of the outer endwall 453 opposite and axially distal to the location of the leading edge 461. When the first turbine nozzle segment 451*a* is installed in the gas turbine engine 100, the leading edge 461, the outer forward rail 455, and the inner forward rail 459 may be located axially forward and upstream of the trailing edge 462, the outer aft rail 454, and the inner aft rail 458. The leading edge 461 may be the point at the upstream end of the airfoil 460 with the maximum curvature and the trailing edge 462 may be the point at the downstream end of the airfoil 460 with maximum curvature. In the embodiment illustrated in FIG. 1, the first turbine nozzle segment 451 is part of the first stage of turbine nozzles 450 adjacent the combustion chamber 390. In other embodiments, the first turbine nozzle segment 451 is located within a turbine nozzle 450 of another stage The pressure side wall 463 spans or extend from the leading edge 461 to the trailing edge 462 and from the outer endwall 453 to the inner endwall 457. The pressure side wall 463 may include a concave shape. The suction side wall 464 may also span or extend from the leading edge 461 to the trailing edge 462 and from the outer endwall 453 to the inner endwall 457. The suction side wall 464 may include a convex shape. The leading edge 461, the trailing edge 462, the pressure side wall 463 and the suction side wall 464 may contain a cooling cavity there between.

The airfoil 460 can have multiple cooling holes or apertures, such as leading edge cooling apertures. The leading edge cooling apertures can be pressure side cooling apertures and/or showerhead cooling apertures. The airfoil 460 can also have trailing edge cooling apertures 467. Each cooling hole or cooling aperture may be a channel extending through a wall of the airfoil 460. Each set of cooling apertures may be grouped together in a pattern, such as in a row or in a column.

In the embodiment illustrated in FIG. 2, the first turbine nozzle segment 451*a* includes second airfoil 470. Second airfoil 470 may be circumferentially offset from airfoil 460. Second airfoil 470 may include the same or similar features as airfoil 460 including second leading edge 471 and a second trailing edge (not shown), and various cooling apertures. The suction sidewall and pressure sidewall of the airfoil 470 are not labeled in FIG. 2.

The various components of first turbine nozzle segment 451*a* including outer shroud 452, inner shroud 456, airfoil 460, and second airfoil 470 may be integrally cast or metalurgically bonded to form a unitary, one piece assembly thereof.

The turbine nozzle segments 451 can have a first segment side 477 and a second segment side 478. The first segment side 477 can be disposed proximate to the suction side wall 464 of the airfoil 460. The second segment side 478 can be disposed opposite the first segment side 477 and be proximate to the pressure side wall 463 of the airfoil 470.

The outer shroud 452 of the enlarged first turbine nozzle segment 451*a* can include a first side seal strip groove 481*a*. The first side seal strip groove 481*a* can be disposed along the first segment side 477. The first side seal strip groove 481*a* can extend from the forward side of the first turbine nozzle segment 451*a* to the aft side of the turbine nozzle segment 451. In other words the first side seal strip groove 481*a* can extend from proximate the outer forward rail 455 to the outer aft rail 454. In an example, the first side seal strip groove 481*a* can be a groove along the outer shroud 452 disposed proximate to the outer endwall 453. In another example, the first side seal strip groove 481*a* can have an elliptical or another shaped cross-section. The first side seal strip groove 481*a* can be shaped utilizing electrical discharge machining.

The outer shroud 452 of the first turbine nozzle segment 451*a* can include a second side seal strip groove 481*b*. The second side seal strip groove 481*b* includes similar characteristics to the first side seal strip groove 481*a*. The second side seal strip groove 481*b* can be disposed proximate to the airfoil 470 or to second segment side 478 of the turbine nozzle segment 451. When the first side seal strip groove 481*a* of the first turbine nozzle segment 451*a* and the second side seal strip groove 481*b* of a second turbine nozzle segment 451*b* are disposed adjacent to each other, they can form a seal strip slot 481*c*.

Figure 3:
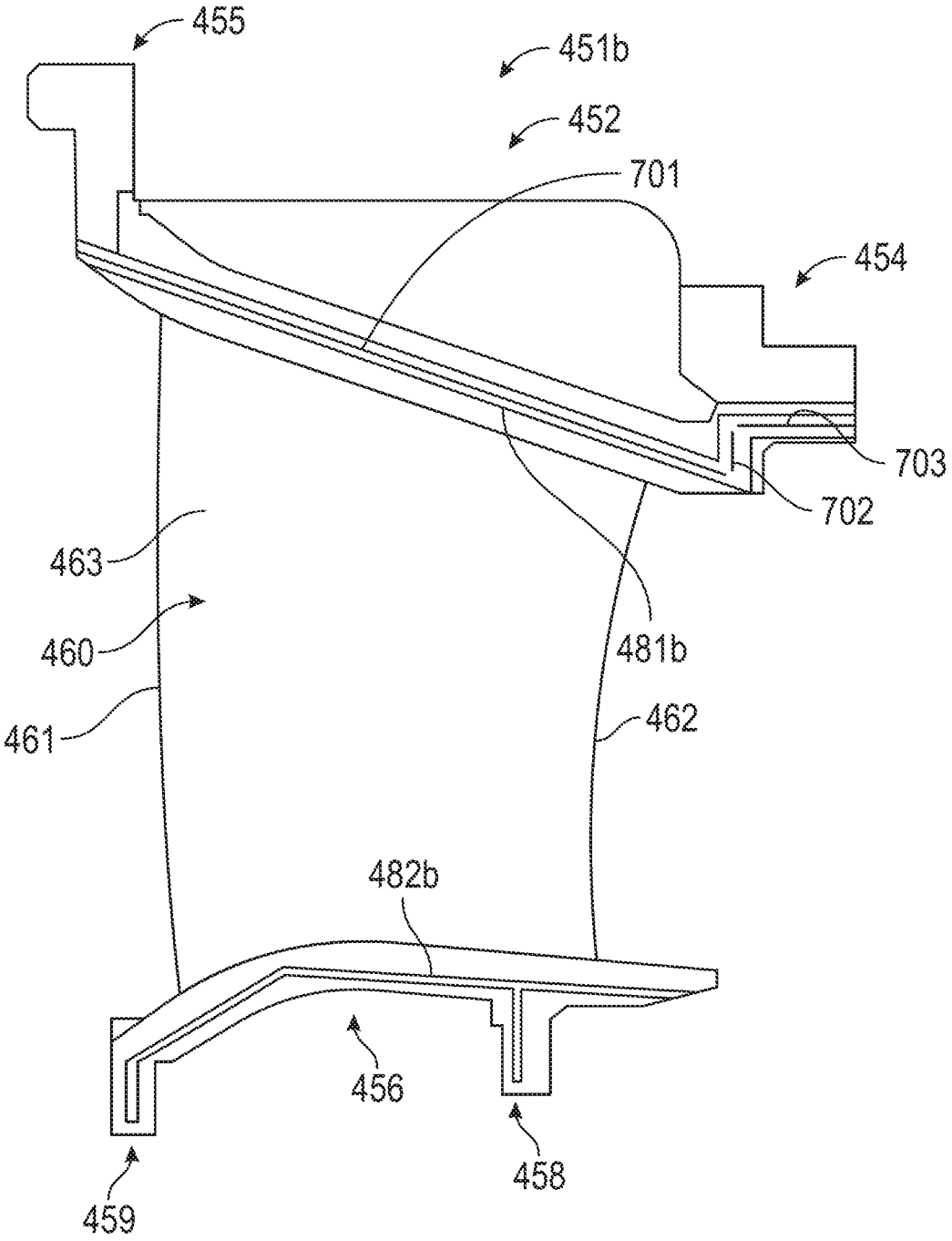
FIG. 3 is a pressure side view of a turbine nozzle segment from FIG. 2.

FIG. 3 is a pressure side view of a turbine nozzle segment from FIG. 2. The second turbine nozzle segment 451*b* can include several seal strip grooves 481*b*, 482*b*, that can make up several seal strip slots 481*c*, 482*c* with similar respective seal strips grooves on an adjacent first nozzle segment 451*a*. The second turbine nozzle segment 451*b* can include several seal strip assemblies 701, 702, and 703. The seal strip assembly 701 can be disposed within the seal strip slot 481*c* and be disposed radially outward of the airfoils 460, 470. The seal strip assembly 701 can extend from proximate the aft end of the outer shroud 452 towards the forward end of the outer shroud 452. In other words, the seal strip assembly 701 can extend from proximate the outer forward rail 455 to the outer aft rail 454.

The seal strip assembly 702 can be disposed within the seal strip slot 481*c* and be disposed radially outward of the airfoils 460, 470 and be disposed proximate to the forward end of the seal strip assembly 701. In other words the seal strip assembly 702 can be disposed proximate the outer aft rail 454. The seal strip assembly 702 can extend radially outward from proximate the forward end of the seal strip assembly 701.

The seal strip assembly 703 can be disposed within the seal strip slot 481*c* and be disposed radially outward of the airfoils 460, 470 and be disposed proximate to the radially outward end of the seal strip assembly 702. In other words the seal strip assembly 703 can be disposed proximate the outer aft rail 454. The seal strip assembly 703 can extend from proximate the radially outward end of the seal strip assembly 702 in the forward direction.

Figure 4:
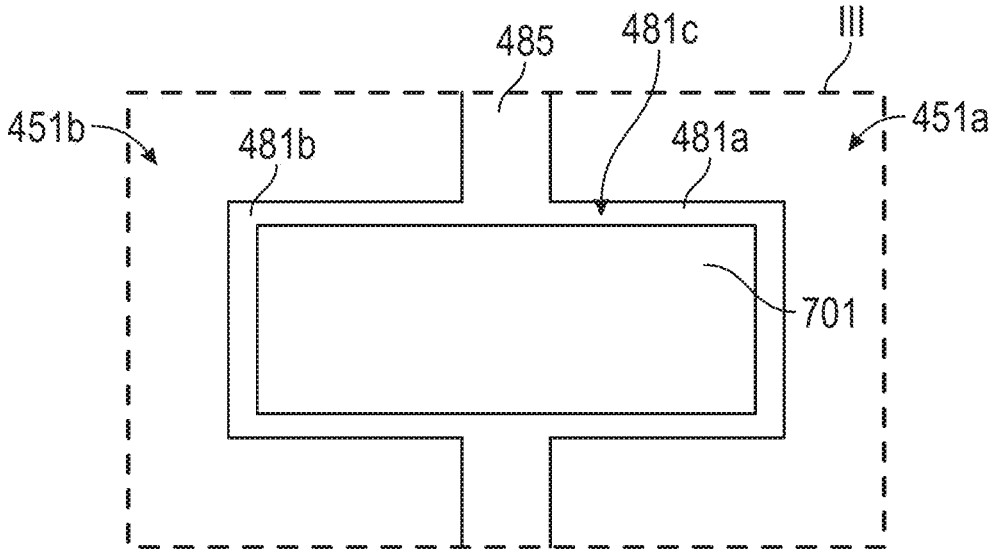
FIG. 4 is an enlarged end view of the seal strip slot in FIG. 2 shown in box III.

FIG. 4 is an enlarged end view of the seal strip slot in FIG. 2 shown in box III. As shown in an embodiment, two turbine nozzle segments 451*a*, 451*b* may be positioned adjacent to each other and create a seal strip gap 485. The two turbine nozzle segments 451*a*, 451*b* can be positioned next to each other and the first side seal strip groove 481*a* and the second side seal strip groove 481*b* can closely align to form the seal strip slot 481*c*. In an embodiment the seal strip assembly 701 may be disposed within the seal strip slot 481*c* and span across the seal strip gap 485 between the turbine nozzle segments 451*a*, 451*b*. The seal strip assembly 701 can extend from the first side seal strip groove 481*a* of the first turbine nozzle segment 451*a* to the second side seal strip groove 481*b* of the second turbine nozzle segment 451*b*. The seal strip assembly may extend from the forward ends towards the aft ends of the turbine nozzle segments 451*a*, 451*b*.

Figure 5:
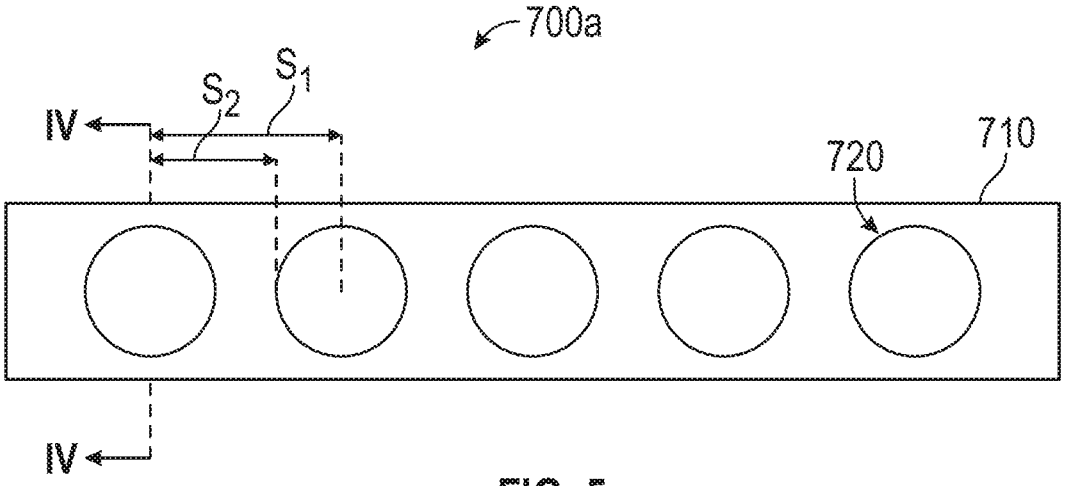
FIG. 5 is a plan view of an example seal strip assembly.

FIG. 5 is a plan view of an example seal strip assembly. A seal strip assembly 700*a* includes a backing plate 710 and bimetal disks 720 The backing plate 710 may be a flat strip and have a rectangular. Each bimetal disk 720 can have a circular, spherical, or elliptical shape when viewed from plan view as shown in FIG. 5. The bimetal disks 720 may be positioned relative to an on center spacing S1. The on center spacing S1 is the distance between the center of a bimetal disk 720 and the center of the next bimetal disk 720. The bimetal disks 720 may be positioned relative to a clearance spacing S2, which is the free space distance between each of the bimetal disk 720. The bimetal disks 720 can have a strip width spacing which is the distance between the center of each bimetal disk and the center line of the backing plate 710. In an embodiment shown, the strip width spacing is equal to zero.

In an example the bimetal disk 720 can vary in shape and size such as varying radiuses. The bimetal disk 720 width/radius can measure from 0.25 to 1.0 of the backing plate 710 width, In an example, the bimetal disks 720 have varying center spacing S1 and clearance spacing S2 from bimetal disk 720 to bimetal disk 720. The center spacing S1 can range from 1 to 3 diameters. The bimetal disks 720 can comprise high temperature alloy that may have high Nickel or Chromium content, and is oxidation resistant. In an example, the backing plate 710 can be made of steel or high temperature such as Alloy 214 or Alloy-X.

Figure 6:
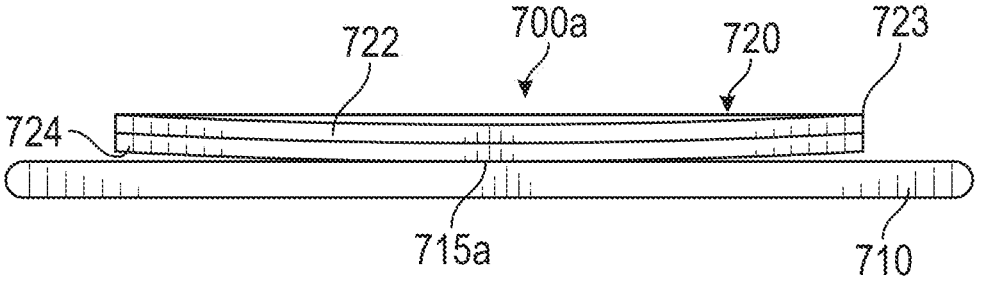
FIG. 6 is a cross section of the seal strip assembly of FIG. 5 taken along line IV-IV.

FIG. 6 is a cross section of the seal strip assembly of FIG. 5 taken along line IV-IV. The bimetal disks 720 can be attached or connected to the backing plate 710 by welding, brazing, or may comprise adhesive, or a mechanical attachment such as a nut and bolt, or other mechanical fasteners of the like.

The bimetal disk 720 can have multiple layers including a first layer 724, a second layer 722 and an edge 723. The first layer 724 may be disposed proximate to the backing plate 710. The second layer 722 may be disposed adjacent of the first layer 724 and opposite from the backing plate 710. In other words the first layer 724 may be disposed between the backing plate 710 and the second layer 722. The edge 723 can be disposed on the outer perimeter of the second layer 722 and opposite from the backing plate 710. The bimetal disks 720 can have a concave spherical curvature, or bowl shaped, in which the centers of the bimetal disks 720 are closer to the backing plate 710 than the edges 723. In other words, the bimetal disk can have a concave curvature with respect to facing away from the backing plate 710. In other examples, each of the bimetal disks 720 can have parabolic curvature, elliptical curvature, or squircle curvature. The first layer 724 can have a first coefficient of thermal expansion. The second layer 722 can have a second coefficient of thermal expansion that is lower than the first coefficient of thermal expansion. Alternatively the second layer 722 may have a higher coefficient of thermal expansion than the first layer 724. The first layer 724 and second layer 722 can be bonded together and act as one thermostatic bimetal disk 720.

The bimetal disks 720 can further include a first surface 726, a second surface 727, and a bimetal perimeter 725. The first surface 726 can be disposed proximate to the bottom of each of the bimetal disks 720. The first surface 726 can be disposed adjacent to the backing plate 710. The first surface 726 can be disposed between the second layer 722 and the backing plate 710. The second surface 727 can be disposed opposite of the first surface 726. The second surface 727 can be disposed proximate to the top of each of the bimetal disks 720. The first surface 726 can be disposed opposite to the backing plate 710. The bimetal perimeter 725 can be disposed along the outer surface and may extend around the outer circumference of each of the bimetal disks 720. The edge 723 can be formed from and located where the second surface 727 and the bimetal perimeter 725 meet. In other words the edge 723 can be disposed at the intersection of the second surface 727 and the bimetal perimeter 725.

Figure 7:
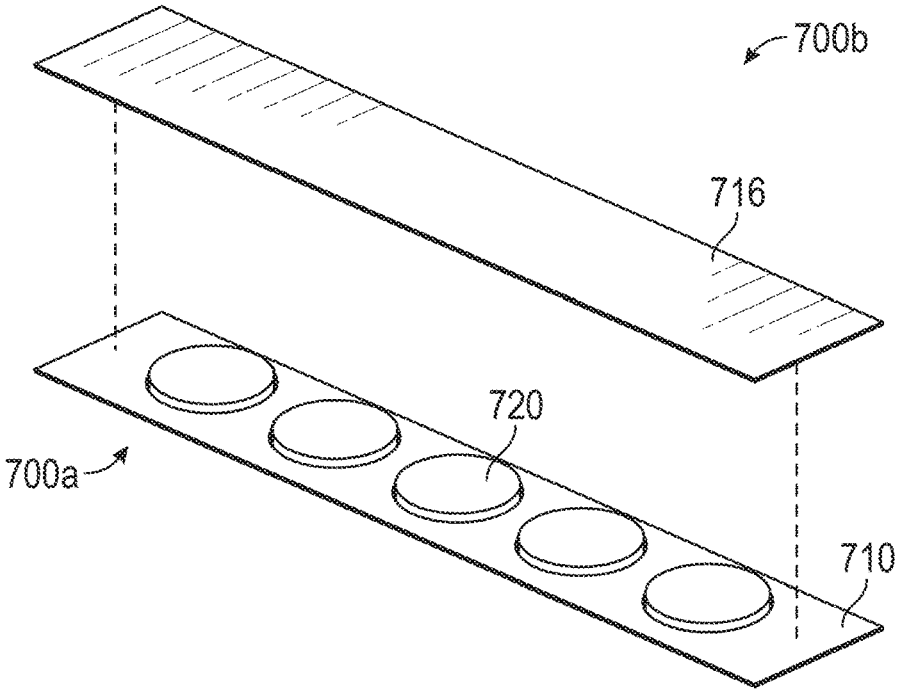
FIG. 7 is a perspective view of an example seal strip assembly with a top stiffener plate shown exploded from the seal strip assembly of FIG. 5.

FIG. 7 is a perspective view of an example seal strip assembly with a top stiffener plate shown exploded from the seal strip assembly of FIG. 5. The seal strip assembly 700*a* can be positioned adjacent to a top stiffener plate 716 to create a seal strip assembly 700*b*. The top stiffener plate 716 can be connected to or joined with the bimetal disk 720 at the edges 723. The top stiffener plate 716 can be shaped the same as or similar to the backing plate 710. The top stiffener plate 716 can be made of steel or high temperature such as Alloy 214 or Alloy-X.

Figure 8:
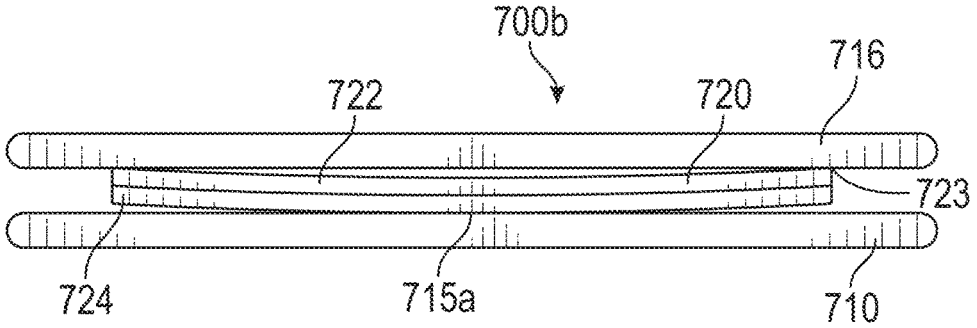
FIG. 8 is a cross section of the seal strip assembly of FIG. 7.

FIG. 8 is a cross section of the seal strip assembly of FIG. 7. In an example the top stiffener plate 716 can be disposed adjacent to the edge 723. In an example the top stiffener plate 716 contacts the edge 723 of the bimetal disk 720 and is formed to create a seal with seal strip slots 481*c*, 482*c*. In an example the top stiffener plate 716 is not joined to the edge 723 or second layer 722. The tip stiffener plate 716 can be connected to the edge 723 by welding, brazing, adhesive, or mechanical fasteners, or other fasteners of the like. The second surface 727 can be disposed adjacent to the top stiffener plate 716.

Figure 9:
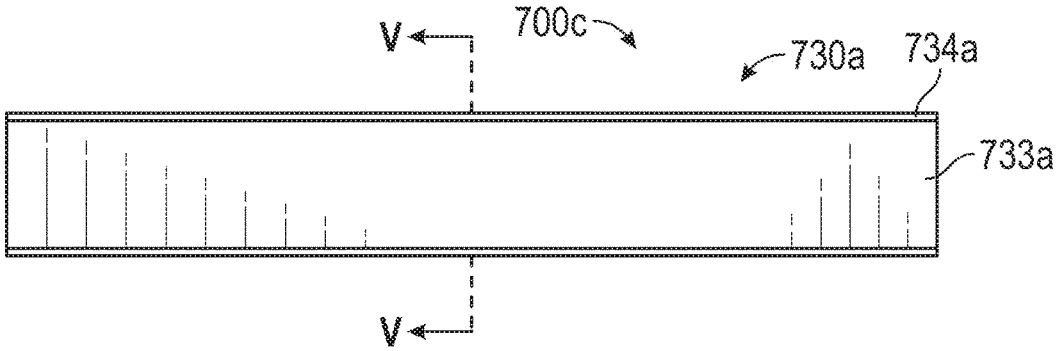
FIG. 9 is a plan view of an example seal strip assembly.

FIG. 9 is a plan view of an example seal strip assembly. A seal strip assembly 700*c* includes a strip seal 730*a*. The strip seal 730*a* includes a mounting section 733*a* and a curved section 734. The mounting section 733*a* can have a rectangle or linear shape. The curved sections 734 can extend away from the long side of the mounting section 733*a*. In an example, the strip seal 730*a* is made of sheet metal and may comprise steel.

Figure 10:
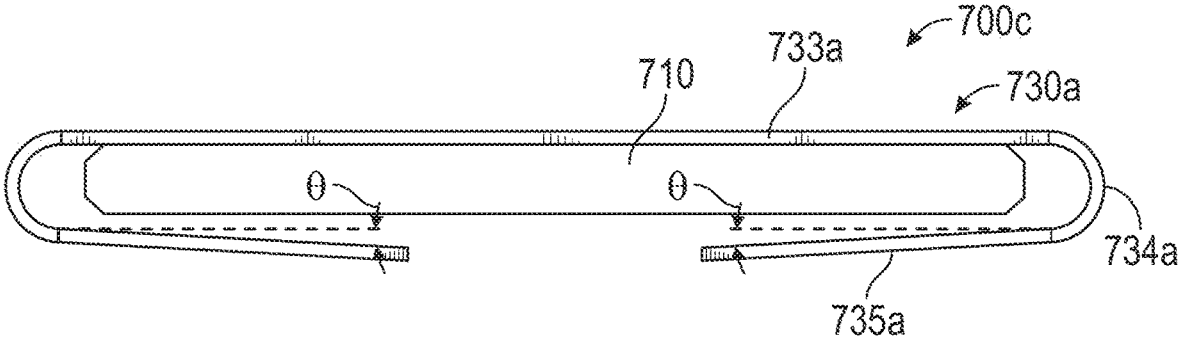
FIG. 10 is a cross section of the seal strip assembly of FIG. 9 along the line V-V.

FIG. 10 is a cross section of the seal assembly from FIG. 9 along the line V-V. The seal strip assembly 700*c* can further include a backing plate 710. The backing plate 710 may be disposed adjacent to the mounting section 733*a*. In an example the backing plate 710 is connected to the mounting section 733*a*. The strip seal 730*a* can further include a leaf seal section 735. The leaf seal section 735 may linearly extend from the curved section 734 at an angle θ from horizontal and can cantilever from the curved section 734. The curved section 734 can be shaped like a half of a hollow cylinder extending into the page. The curved section 734 can be joined to the mounting section 733*a* and the leaf seal section 735.

Figure 11:
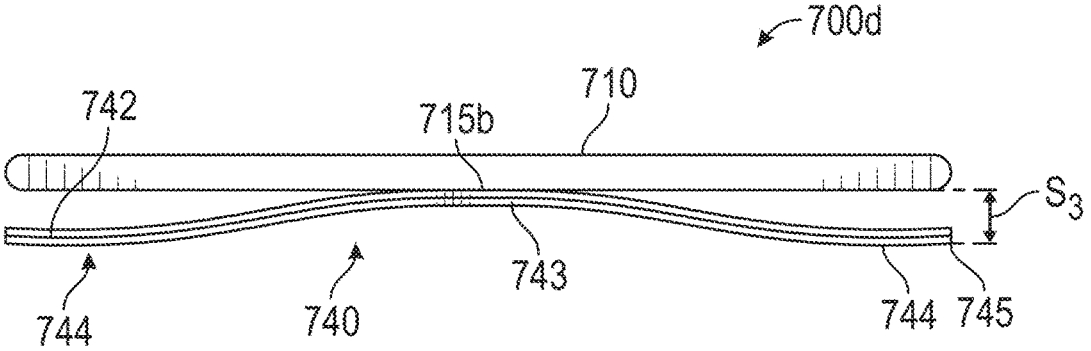
FIG. 11 is a cross section of an example seal strip embodiment.

FIG. 11 is a cross-section of an example seal strip assembly. A seal strip assembly 700*d* can include a backing plate 710 and a bimetal strip 740. The backing plate 710 may have a rectangular or linear shape. The bimetal strip 740 may be connected or attached to the backing plate 710 by welding, brazing, adhesive, nut and bolt, or other mechanical fasteners of the like. A first layer 742 may be connected to the bottom of the backing plate 710. In an example the bimetal strip 740 may extend approximately along the length of the backing plate 710. The bimetal strip 740 can include the first layer 742, a second layer 743, and leaf seals 744. The first layer 742 may be disposed adjacent the backing plate 710. The first layer 742 may comprise a metal with a coefficient of thermal expansion greater than the second layer 743. In other words, the second layer 743 expands less than the first layer 742 when the two layers are exposed to an increase in temperature. The second layer 743 may be disposed opposite of the first layer 742. The leaf seals 744 extend from the center of the bimetal strip 740 towards the edges for the backing plate 710. In other words the leaf seals 744 extend from where the bimetal strip 740 is connected to the backing plate 710. The leaf seals 744 can have edges 745 that are deposed along an outer bimetal perimeter 478 of the second layer 743 and can be disposed further from the backing plate 710 than the center of the bimetal strip 740. The edges 745 may be spaced from the backing plate 710 at a spacing S3 which that equals a clear spacing between the bimetal strip 740 and the backing plate 710 plus the thickness of the bimetal strip 740. The bimetal strip 740 can further include a first surface 746, a second surface 747, and the bimetal perimeter 748. The first surface 746 can be disposed proximate to the bottom of each of the bimetal strip 740. The first surface 746 can be disposed adjacent to the backing plate 710. The first surface can be disposed between the second layer 743 and the backing plate 710. The second surface 747 can be disposed proximate to the top of the bimetal strip 740. The second surface 747 can be disposed opposite to the backing plate 710. The second surface 747 can be disposed opposite of the first surface 746. The bimetal perimeter 748 can be disposed along an outer surface and may extend along the outer edge of the bimetal strip 740. The edge 745 can be formed from and located where the second surface 747 and the bimetal perimeter 748 meet. In other words the edge 745 can be disposed at the intersection of the second surface 747 and the bimetal perimeter 748.

Figure 12:
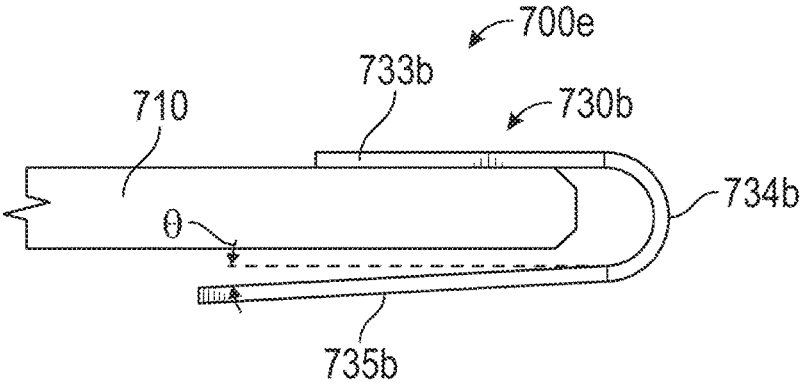
FIG. 12 is a cross section of an example seal strip embodiment.

FIG. 12 is a cross section of an example seal assembly. The seal strip assembly 700*e* has similar features to the seal strip assembly 700*c* and the descriptions of the features shown in FIG. 10 can be applied again to the similar referenced features shown in FIG. 12. The seal strip assembly 700*e* can include a strip seal 730*b* that includes a mounting section 733*b* that does not extend to the opposite side of the backing plate 710 and divides the strip seal 730*b* into two pieces.

Figure 13:
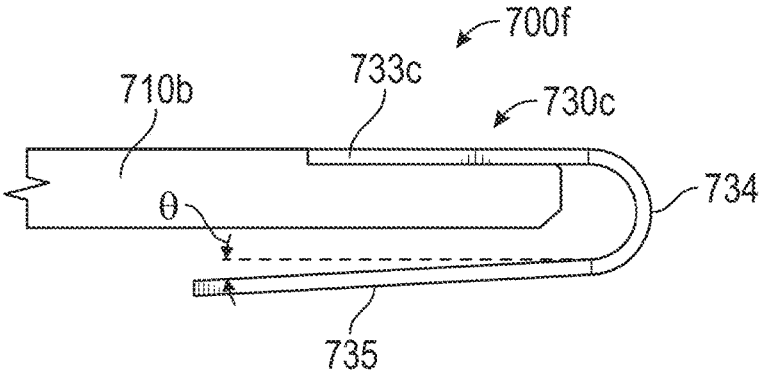
FIG. 13 is a cross section of an example seal strip embodiment.

FIG. 13 is a cross section of an example seal assembly. The seal strip assembly 700*f* has similar features to the seal strip assembly 700*c*, 700*e* and the backing plate 710*b* has similar features to backing plate 710, therefore the descriptions of the features shown in FIG. 10 and FIG. 12 can be applied again to the similar referenced features shown in FIG. 13. The seal strip assembly 700*f* can include a strip seal 730*c* that includes a mounting section 733*c* that does not extend to the opposite side of the backing plate 710*b* and is recessed into the backing plate 710*b* so that the top of the backing plate and top of the mounting section 733*c* are substantially flush.

Figure 14:
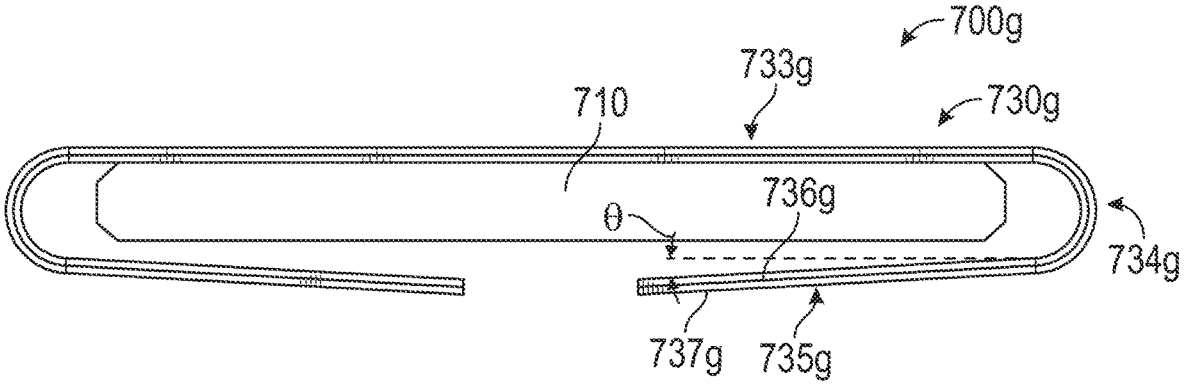
FIG. 14 is a cross section of an example seal strip embodiment.

FIG. 14 is a cross section of an example seal assembly. The seal strip assembly 700*g* can include a bimetal strip seal 730*g* and a backing plate 710. The bimetal strip seal 730*g* can include a mounting section 733*g*. The backing plate 710 may be disposed adjacent to the mounting section 733*g*. In an example the backing plate 710 is connected to the mounting section 733*g*. The mounting section 733*g* may be connected or attached to the backing plate 710 by welding, brazing, adhesive, nut and bolt, or other mechanical fasteners of the like. A first layer 736*g* may be connected to the top of the backing plate 710. In an example the bimetal strip seal 730*g* may extend approximately along the length of the backing plate 710.

The bimetal strip seal 730*g* can further include a leaf seal section 735*g*. The leaf seal section 735*g* may linearly extend from the curved section 734*g* at an angle θ from horizontal and can cantilever from the curved section 734*g*. The curved section 734*g* can be shaped like a half of a hollow cylinder extending into the page. The curved section 734*g* can be joined to the mounting section 733*a* and the leaf seal section 735*g*. The seal strip assembly 700*g* can include a first layer 736*g* and a second layer 737*g*. The first layer 736*g* may be disposed proximate to the backing plate 710. The second layer 737*g* may be disposed adjacent of the first layer 736*g* and opposite from the backing plate 710. In other words the first layer 736*g* may be disposed between the backing plate 710 and the second layer 737*g*. The first layer 736*g* can have a first coefficient of thermal expansion. The second layer 737*g* can have a second coefficient of thermal expansion that is lower than the first coefficient of thermal expansion. Alternatively the second layer 737*g* may have a higher coefficient of thermal expansion than the first layer 736*g*. The first layer 736*g* and second layer 737*g* can be bonded together and act as one thermostatic bimetal strip seal 730*g*.

Figure 15:
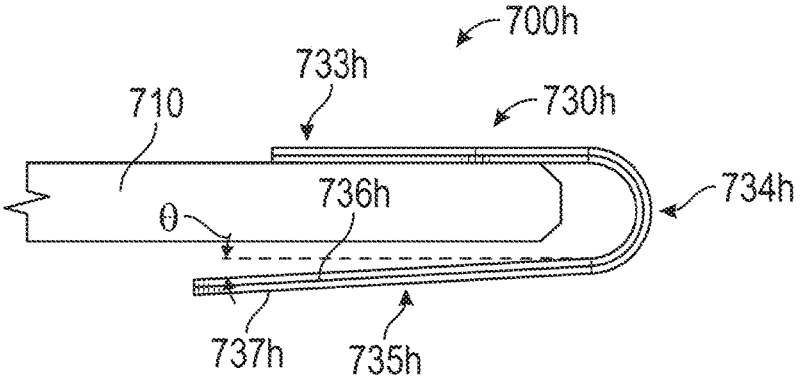
FIG. 15 is a cross section of an example seal strip embodiment.

FIG. 15 is a cross section of an example seal assembly. The seal strip assembly 700*h* has similar features to the seal strip assembly 700*g* and the descriptions of the features shown in FIG. 14 can be applied again to the similar referenced features shown in FIG. 15. The seal strip assembly 700*h* can include a bimetal strip seal 730*h* that includes a mounting section 733*h* that does not extend to the opposite side of the backing plate 710 and divides the bimetal strip seal 730*h* into two pieces.

INDUSTRIAL APPLICABILITY

During operation, the nozzle endwalls 453, 457 and turbine nozzle segments 451 that form a turbine nozzle 450 can create gaps, like seal strip gaps 485, and allow air to leak out, leading to reduced turbine efficiency and engine power. Generally hot air at high pressure is present around airfoils 460, 470 during operation of a gas turbine engine 100. In other words, the space between the outer endwall 453 and inner endwall 457 contains hotter air and at higher pressures in comparison to the air located radially inward of the inner endwall 457 and outward from the outer endwall 453. This air leakage can be reduced by incorporating sealing strip assemblies 700. The seal strip assemblies can include any one of the seal strip assemblies 700*a*, 700*b*, 700*c*, 700*d*, 700*e*, 700*f*, 700*g*, 700*h*, 701, 702, or 703 described. The seal strip assemblies can be formed to fit the nozzle slots such as seal strip slots 481*c*, 482*c* with some interference. The sealing strip assemblies can be formed to provide a stronger seal as the surrounding pressure and/or temperature increases.

In an example, the seal strip assembly includes a backing plate 710 that is operable to provide thermal insulation and a bimetal element with a nonlinear cross section disposed proximate to the backing plate 710. The bimetal element may include the bimetal disks 720, the bimetal strip 740, or the bimetal strip seal 730*g*, 730*h*. The bimetal element can include a first layer 724, 742, 736*g*, 736*h* disposed adjacent to or joined to the backing plate 710 and having a first coefficient of thermal expansion. The bimetal element can further include, a second layer 722, 743, 737*g*, 737*h* disposed opposite from the first layer 724, 742, 730*g*, 730*h* having a second coefficient of thermal expansion. The second coefficient of thermal expansion may be lower than the first coefficient of thermal expansion. The bimetal element can include a first surface 726, 746 a second surface 727, 747 and a bimetal perimeter 725, 748. The bimetal element can include an edge 723, 745 disposed along the outer perimeter where the bimetal perimeter 725, 748 and the second surface 747.

In an example, the seal strip assembly 700*b* includes bimetal disks 720 that are connected to the backing plate 710. The bimetal disk 720 can be sandwiched between the backing plate 710 and the top stiffener plate 716. The second layer 722 and the edge 723 can be disposed adjacent the top stiffener plate 716 and can include the first layer 724 disposed adjacent the backing plate 710. The second layer 722 can have a lower coefficient of thermal expansion than the first layer 724. In other words, the second layer 722 can be formed to expand or deform less than the first layer 724 after a temperature increase has been experienced. As the surrounding temperature increases, the first layer 724 may expand more that the second layer 722 and the bimetal disks 720 can be formed to deform and increase in curvature with an increase in surrounding temperature, providing for a more pronounced shape. The additional deformation of the bimetal disks 720 increases the separating force between the backing plate 710 and the receiving layer such as the seal strip slots 481*c*, 482*c* or a top stiffener plate 716, thus increasing the seal. In an example, as the bimetal disks 720 expand with a temperature increase, the edges 723 can be formed to create circular contact pressure against the top stiffener plate 716 and the center of the bimetal disks 720 can be formed to create a point of pressure at the connection point onto the backing plate 710. In other words, the edge 723 can be formed to create contact pressure against the top stiffener plate 716 in the shape of the perimeter 725 of the bimetal disks 720. The pressure created by the bimetal disks 720 can push the backing plate 710 and the top stiffener plate 716 against the walls of the seal strip slots 481*c*, 482*c* and both plates can be formed to create a seal with the walls of the seal strip slots 481*c*, 482*c*.

The backing plate 710 can be formed to restrict the thermal deformation movement of the bimetal disk 720 adjacent to the backing plate 710 and encourage the curvature to increase proximate to the edges 723. The backing plate 710 can be operable to act as a thermal barrier and may protect the bimetal disks 720 from high temperature gases and provide oxidation resistance and may improve the material properties of the bimetal disks 720. In an example, the backing plate 710 may be a layer of material with a low thermal conductivity and may provide thermal insulation. In an example, the backing plate 710 is exposed to relatively hot air and the top stiffener plate 716 is exposed to air relatively cooler than the hot air. In an example, the top stiffener plate 716 is exposed to relatively hot air and the backing plate 710 is exposed to air cooler than the hot air. In an example, the bimetal disk 720 can be formed to fit or compress into slots such as seal strip slots 481*c*, 482*c* with some interference and provide preloaded pressure inside the slots.

The seal strip assembly 700*c*, 700*e*, 700*f* can provide an initial sealing pressure based on the deflection of the leaf seal during installation into the seal strip slot. The leaf seal section 735 can be formed to compress towards the backing plate 710, 710*b* and be formed to fit into slots such as the seal strip slots 481*c*, 482*c* with some interference and provide preloaded pressure inside the slots. The leaf seal section 735 is cantilevered and can provide for easier preloading and compressing and can provide a tapered fit during assembly and placement into slots. The seal strip assembly 700*c*, 700*e*, 700*f* can provide sealing pressure based on the amount of pressures difference across the seal or a delta pressure. Both the delta pressure and initial sealing pressure mechanisms can work together or independently to provide a seal. During operation of a gas turbine engine 100, the space between the inner endwall 453 and outer end wall 457 can increase in pressure and have a greater pressure outside of this area. In other words, higher pressure at the outer shroud 452 and inner shroud 456 The seal strip assembly 700*c*, 700*e*, 700*f* can utilize the difference in pressure to seal the gaps between the seal strip assembly 700*c*, 700*e*, 700*f* and the seal strip slots 481*c*, 482*c*. The seal strip assembly 700*c*, 700*e*, 700*f* can be formed to create a seal with the seal strip slots 481*c*, 482*c* by resisting a first pressure adjacent to the leaf seal section 735 and a second pressure adjacent the mounting section 733*a*, 733*b*, 733*c*. The first pressure can be greater than the second pressure.

In an example, the seal strip assembly 700*d* includes a bimetal strip 740 that can be formed to expand away from the backing plate 710 and provide a seal to a seal strip slot 481*c*, 482*c*. In an example, the seal strip assembly 700*g*, 700*h* includes a bimetal seal strip 730*g*, 730*h* that can be formed to expand away from the backing plate 710 and provide a seal to a seal strip slot 481*c*, 482*c*. The first layer 724, 742, 736*g*, 736*h* and second layer 722, 743, 737*g*, 737*h* can be bonded together and act as one thermostatic bimetal element 720, 740, 730*g*, 730*h*.

Although this invention has been shown and described with respect to detailed embodiments thereof, it will be understood by those skilled in the art that various changes in form and detail thereof may be made without departing from the spirit and scope of the claimed invention. Accordingly, the preceding detailed description is merely exemplary in nature and is not intended to limit the invention or the application and uses of the invention. In particular, the described embodiments are not limited to use in conjunction with a particular type of gas turbine engine. For example, the described embodiments may be applied to stationary or motive gas turbine engines, or any variant thereof. Furthermore, there is no intention to be bound by any theory presented in any preceding section. It is also understood that the illustrations may include exaggerated dimensions and graphical representation to better illustrate the referenced items shown, and are not consider limiting unless expressly stated as such.

It will be understood that the benefits and advantages described above may relate to one embodiment or may relate to several embodiments. The embodiments are not limited to those that have any or all of the stated benefits and advantages.

What is claimed is:

1. A seal strip assembly for seal strip slots formed by adjacent seal strip grooves in adjacent turbine nozzle segments within a gas turbine engine, the sealing strip assembly comprising:
- a backing plate;
- a bimetal element disposed proximate to the backing plate and having
  - a first layer having a first coefficient of thermal expansion,
  - a second layer disposed adjacent to the first layer and having a second coefficient of thermal expansion, the second coefficient of thermal expansion being lower than the first coefficient of thermal expansion;
- a top stiffener plate disposed adjacent to the second layer; and
- the bimetal element further comprising:
  - a first surface disposed adjacent to the backing plate,
  - a second surface disposed adjacent to the top stiffener plate,
  - a bimetal perimeter disposed along an outer surface, and
- an edge disposed at the intersection of the second surface and the bimetal perimeter.

2. The seal strip assembly of claim 1, wherein the first layer is connected to the backing plate.

3. The seal strip assembly of claim 1, wherein the top stiffener plate is connected to the second layer.

4. The seal strip assembly of claim 1, wherein the backing plate and top plate each have a flat strip shape.

5. The seal strip assembly of claim 1, wherein the bimetal element is a bimetal disk.

6. The seal strip assembly of claim 5, wherein the bimetal element has a concave curvature with respect to facing away from the backing plate.

7. The seal strip assembly of claim 6, wherein the bimetal disk is formed to increase in curvature with an increase in temperature.

8. A seal strip assembly for a seal strip slot located between turbine nozzle segments within a gas turbine engine, the sealing strip assembly comprising:

bimetal elements, each of the bimetal elements having a first layer having a first coefficient of thermal expansion, and a second layer connected to the first layer and having a second coefficient of thermal expansion, the second coefficient of thermal expansion being lower than the first coefficient of thermal expansion;

a backing plate connected to the first layer;

a top plate disposed adjacent to the second layer of each of the bimetal elements; and the bimetal elements each further comprising:

a first surface disposed between the second layer and the backing plate, a second surface disposed opposite the first surface, a bimetal perimeter disposed along an outer surface, and an edge disposed at the intersection of the second surface and the bimetal perimeter.

9. The seal strip assembly of claim 8, wherein each of the bimetal elements has a concave curvature with respect to facing away from the backing plate.

10. The seal strip assembly of claim 9, wherein each of the bimetal elements is formed to increase in curvature with an increase in temperature.

11. The seal strip assembly of claim 8, wherein the each of the bimetal elements are formed to provide contact pressure between the edge and the top stiffener plate and formed to provide contact pressure to the backing plate at the first layer when exposed to an increase in temperature.

12. The seal strip assembly of claim 11, wherein the top stiffener plate is formed to provide a seal with the sealing strip slots and the backing plate is formed to provide a seal with the sealing strip slots.

13. The seal strip assembly of claim 8, wherein the first layer and second layer are bonded together and act as one thermostatic element.

14. A gas turbine nozzle for a gas turbine engine, the gas turbine nozzle comprising:

a first turbine nozzle segment having a first turbine nozzle first side seal strip groove, and a first turbine nozzle second side seal strip groove;

a second turbine nozzle segment disposed adjacent to the first turbine nozzle segment having a second turbine nozzle first side seal strip groove, and a second turbine nozzle second side seal strip groove aligned with the first turbine nozzle first side seal strip groove;

wherein a seal strip slot is formed by the first turbine nozzle first side seal strip groove and the second turbine nozzle second side seal strip groove; and a seal strip assembly extending from adjacent the first turbine nozzle first side seal strip groove to adjacent the second turbine nozzle second side seal strip groove, including bimetal disks each having a first layer having a first coefficient of thermal expansion, and a second layer connected to the first layer having a second coefficient of thermal expansion, the second coefficient of thermal expansion being lower than the first coefficient of thermal expansion;

a backing plate connected to the first layer of each of the bimetal disks;

a top plate disposed adjacent to the second layer, and the bimetal disks each further comprising:

a first surface disposed between the second layer and the backing plate, a second surface disposed opposite the first surface, a bimetal perimeter disposed around a circumference of the bimetal disk, and an edge disposed at the intersection of the second surface and the bimetal perimeter.

15. The seal strip assembly of claim 14, wherein the bimetal disk is formed to provide contact pressure between the edge and the top stiffener plate and formed to provide contact pressure to the backing plate at the connection to the first layer when exposed to an increase in temperature.

16. The seal strip assembly of claim 15, wherein the top stiffener plate is formed to provide a seal with the sealing strip slots and the backing plate is formed to provide a seal with the sealing strip slots.

17. The seal strip assembly of claim 14, wherein the bimetal disks have a concave curvature.

* * * * *